US009199111B2

(12) United States Patent
Flores

(10) Patent No.: US 9,199,111 B2
(45) Date of Patent: Dec. 1, 2015

(54) EXERCISE APPARATUS

(76) Inventor: Leo Flores, Marrero, LA (US)

( * ) Notice: Subject to any disclaimer, the term of this patent is extended or adjusted under 35 U.S.C. 154(b) by 624 days.

(21) Appl. No.: 13/472,071

(22) Filed: May 15, 2012

(65) Prior Publication Data

US 2013/0310232 A1 Nov. 21, 2013

(51) Int. Cl.

| | |
|---|---|
| ***A63B 23/04*** | (2006.01) |
| ***A63B 17/00*** | (2006.01) |
| ***A63B 21/068*** | (2006.01) |
| ***A63B 21/16*** | (2006.01) |
| ***A63B 23/02*** | (2006.01) |
| *A63B 17/04* | (2006.01) |

(52) U.S. Cl.

CPC ..... *A63B 17/00* (2013.01); *A63B 21/068* (2013.01); *A63B 21/16* (2013.01); *A63B 23/0216* (2013.01); *A63B 17/04* (2013.01); *A63B 23/0482* (2013.01); *A63B 2021/169* (2013.01); *A63B 2208/0252* (2013.01); *A63B 2225/093* (2013.01)

(58) Field of Classification Search

CPC ..... A63B 1/00; A63B 23/00; A63B 23/02; A63B 23/035; A63B 2023/003; A63B 2023/006; A63B 2021/169

USPC ..... 482/131

See application file for complete search history.

(56) References Cited

U.S. PATENT DOCUMENTS 5,405,306 A * 4/1995 Goldsmith ..... A61H 1/0237 482/110

7,682,298 B2 * 3/2010 Croft ..... 482/142

* cited by examiner

*Primary Examiner* — Loan H Thanh
*Assistant Examiner* — Rae Fischer
(74) *Attorney, Agent, or Firm* — Keaty Law Firm, LLC

(57) ABSTRACT

An exercise frame made up of two upright members connected by a transverse base member and a transverse link attached to the top portion of the frame. A transverse spring-loaded grip bar is positioned at a height suitable for gripping by user's hands while the user in a lying position in front of the base member. A pair of leg supports is designed to alternately support one or the other of user's legs while the user's rests the Achilles tendon on one of two leg supports carried by the upright members above the grip bar. The user performs exercises designed to strengthen rectus abdominis without flexing user's torso.

2 Claims, 11 Drawing Sheets

EXERCISE APPARATUS

BACKGROUND OF THE INVENTION

The present invention generally relates to exercise equipment and, more particularly, to an exercise rack permitting a user to perform rectus abdominis exercises, including lying leg lifts, lying twists and similar exercises for strengthening the lower abdominal muscles.

A variety of exercise devices and machines have been developed to simulate activities found to be effective in conditioning the body. Some devices are designed to allow the user to perform pull-up exercises, stair stepping, striding (simulating cross-country skiing), lifting weights and the like. While many such machines strengthen different muscles of a human body they are not well equipped for building up abdominal muscles. The fit abs is a goal of many body trainers and coaches.

A conventional advice to improve the abdominal muscle structure is to perform crunches when the user is in a prone position and lifts the upper torso. It was determined that such exercises are non-functional and even dangerous—excessive trunk flexion (bending forward at the waist) puts too much strain on spinal disks, which can eventually lead to a back injury. Some research indicates that repeated stressing of the back as in flexion lowers the back's tolerance to injury. A more preferred type of exercise is designed to strengthen the core muscles—those surrounding the spine—and stiffen the torso using stronger hip and thigh muscles. Rectus abdominis controls the movements of the pelvis which affects the curvature of the spine. This muscle begins on the ribs and connects at the bottom of the pelvis. Since this muscle runs the length of the stomach, full range of motion exercises are most effective to strengthen and tone the rectus abdominis. When a muscle contracts during exercise, it shortens and that is the goal when training the rectus abdominis.

The present invention contemplates elimination of drawbacks associated with conventional exercise equipment and provision of an exercise apparatus that is designed to strengthen the core muscles, while preventing stress on the user's back.

SUMMARY OF THE INVENTION

It is, therefore, an object of the present invention to provide an exercise apparatus suitable for use when performing rectus abdominis exercises.

It is another object of the invention to provide an exercise apparatus that allows the user to perform the core strengthening exercises without inducing stress on the user's spine.

These and other objects of the invention are achieved through a provision of an exercise apparatus that has a frame including a pair of parallel upright members connected by a base member at bottom ends thereof. Each of the upright members carries a transverse arm which extends horizontally at a right angle to a longitudinal axis of the upright member and rearwardly therefrom. A free end of each of the transverse arm is secured to a rear link, which extends in a parallel relationship to the base member and rearwardly thereto. A top plate rests on and extends upwardly from, the rear link. The top plate is adapted for securing to a vertical structural support member.

Extending between the parallel upright members is a vertically-adjustable spring-loaded grip bar member positioned at a pre-determined height above the base member; the grip bar can be moved up and down using a grip bar sleeve which is mounted on a respective upright member and a lock pin securing the grip bar with the grip bar sleeve to a respective upright member. A pair of leg support members is adjustably positionable above the grip bar member and extends forwardly of the upright members, each of the pair of leg support members comprising an L-shaped member having a first elongated portion non-rotatably secured to a respective upright member and a second portion extending at a right angle to the first portion.

The user performs the exercises in a user-defined pattern, while lying on the floor in front of the base member and gripping the grip bar with both hands. The user strengthens the core muscles by lifting and rotating legs and alternating position of the legs supported by the leg support members.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
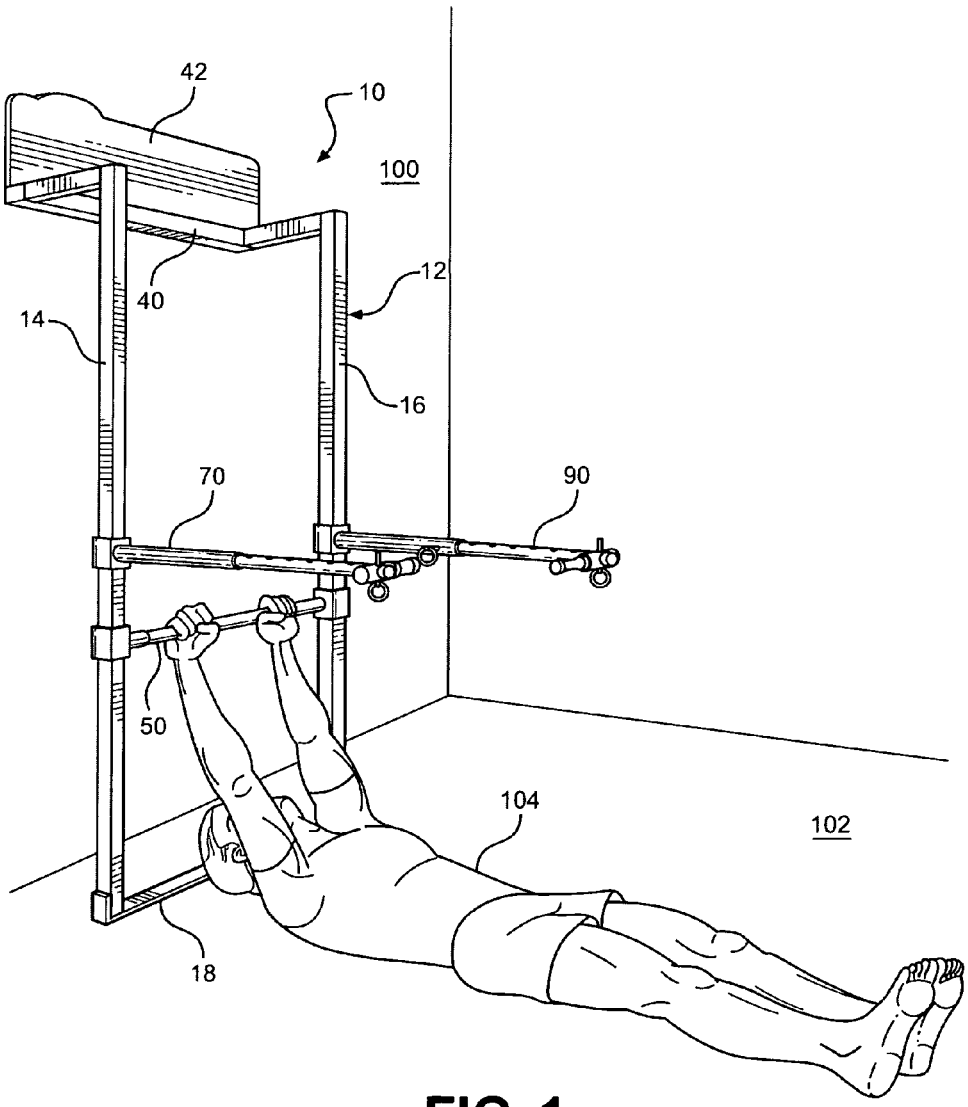
FIG. 1 illustrates the apparatus of the present invention and a user in a lying down position in preparation for performing an exercise in a user-defined pattern.

Turning now to the drawings in more detail, numeral 10 designates the exercise apparatus of the present invention. The apparatus 10 comprises a frame 12 having a pair of parallel upright members 14 and 16 connected by a base member 18 at the bottom ends thereof. Each upright member 14 and 16 is formed as a hollow tubular body of square or rectangular cross-section. Of course, other shapes can be used as well. Each upright member 14 and 16 has a front plate 15, 17, respectively, and a back plate 19, 21, respectively. A plurality of vertically spaced-apart through openings 20 is formed in the back plates 19 and 21, the purpose of which will be described in more detail hereinafter.

The base member 18 comprises a U-shaped plate having a center portion 22 and a pair of transverse end portions 23, 24. The base member 18 is adapted to rest on a horizontal surface, such as a floor. A bottom end 26 of the upright member 14 is secured to the end portion 23 using a bolt (not shown). The bottom end 27 of the upright member 16 is similarly secured to the end portion 24 of the base member 18.

An upper end 30 of the upright member 14 is connected to a transverse arm 32, which extends horizontally at a right angle to a longitudinal axis of the upright member 14 and rearwardly therefrom. An upper end 34 of the upright member 16 is connected to a transverse arm 36, which extends horizontally to a longitudinal axis of the upright member 16 and rearwardly therefrom. The free ends 33, 35 of the arms 32, 36 are secured to a rear link 40, which extends in a parallel relationship to the center portion 22 of the base member 18.

Figure 9:
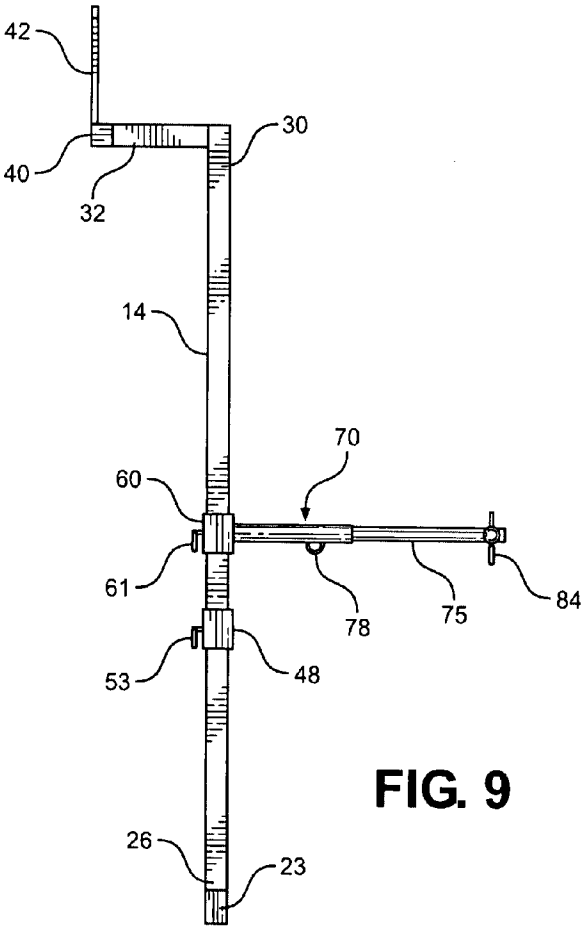
FIG. 9 is a side view of the exercise apparatus of the present invention.

A top plate 42 rests on and extends upwardly from, the rear link 40. The top plate 42 can be secured to a vertical structural support member, such as a wall 100. As can be seen in FIG. 9, the top plate 42 is oriented substantially parallel to the upright members 14, 16 and transversely to the base member 18 and the arm 32.

A pair of grip bar sleeves 48, 49 is mounted on the upright members 14 and 16, respectively. Each of the grip bar sleeves 48, 49 comprises a hollow tubular body having a central opening through which the upright members 14 and 16 can fit. Openings 51, 52 are formed in a back surface of the sleeves 48, 49, and a lock pin 53 is fitted therein. The lock pin 53 can be provided with a ring for easy handling when pulling the lock pin from the sleeves.

The lock pin 53 has a pre-determined length sufficient to extend through the thickness of the sleeve 48, 49 and into one of the openings 20 formed in the back plates 19, 21 of the upright member 14 and 16. The sleeves 48 and 49 are positioned in a vertically aligned position relative to each other. The sleeves 48 and 49 can move vertically up and down along the length of the upright members 14 and 16 depending on the user's height and arm length.

Figure 13:
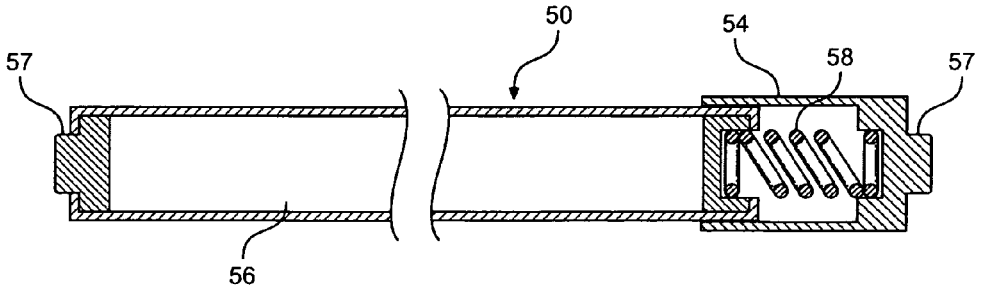
FIG. 13 is a detail sectional view of the grip bar member.
Figure 12:
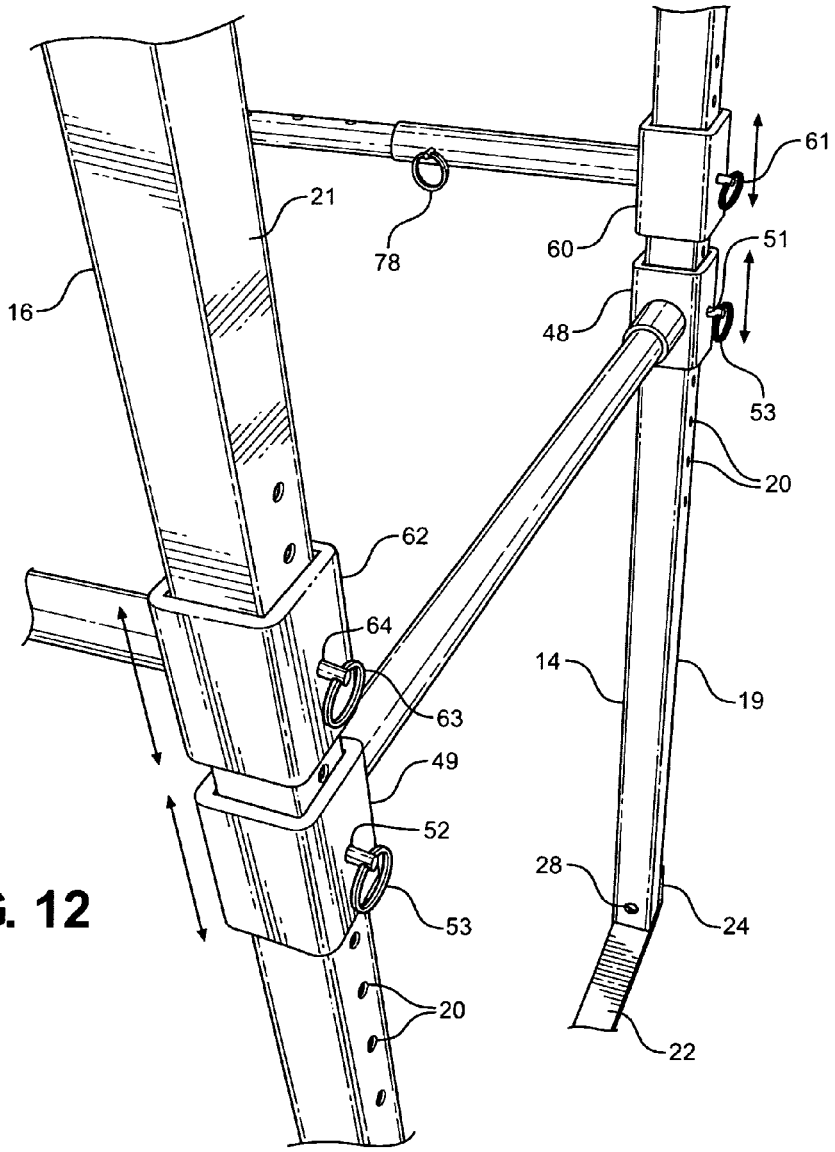
FIG. 12 is a detail rear view of the exercise apparatus of the present invention showing grip bar sleeves and support sleeves secured to the upright members.

Detachably secured between the sleeves 48, 49 is a hollow grip bar 50, which is formed as a two-part member with telescoping portions 54, 56. The ends of the portions 54, 56 of the grip bar 50 are provided with engaging pins 57 which are adapted to fit into side openings formed in the sleeves 48, 49. The grip bar 50 is reversible in a sense that either end thereof can fit into the sleeve 48 or 49. A spring 58 (FIG. 13) is fitted in the hollow portion 54 allowing the telescoping portions 54, 56 move toward each other when engaging the grip bar 50 between the upright members 14 and 16. The spring-loaded grip bar 50 can be moved up and down in relation to a horizontal support surface and the base member 18 by moving the grip bar sleeves 48, 49 up and down using the locking pins 53.

The upright member 14 carries a leg support sleeve 60, which is similar to the sleeve 48 in that it surrounds the upright member 14 and allows the upright member 14 to pass through an opening formed therein. Similarly to the grip bar sleeve 48, the support sleeve 60 is slidably engaged with the upright member 14 and is secured in a desired position using a lock pin 61. A similar support sleeve 62 is slidably engaged with the upright member 16 and is selectively secured thereto using a lock pin 63 extending through an opening 64 formed in the back of the support sleeve 62.

A first leg support member 70 extends forwardly from the support sleeve 60, transversely to the longitudinal axis of the upright member 14. The first leg support member 70 comprises an L-shaped member having a first elongated tubular portion 72 and a second shorter portion 74 secured at a right angle to the elongated portion 72. The elongated portion 72 comprises two parts: a rigidly attached part 73 and a telescopically movable part 75, which slidingly moves, to a certain extent, in relation to the first part 73.

The part 73 of the elongated portion 72 is affixed at one end to the forward plate 65 of the support sleeve 60. An opening 76 is formed adjacent the opposite end of the part 73. The sliding part 75 is provided with an aperture (not shown), which is used for receiving an end of a lock pin 78 adapted to non-rotatably secure the part 73 with the part 75.

Figure 11:
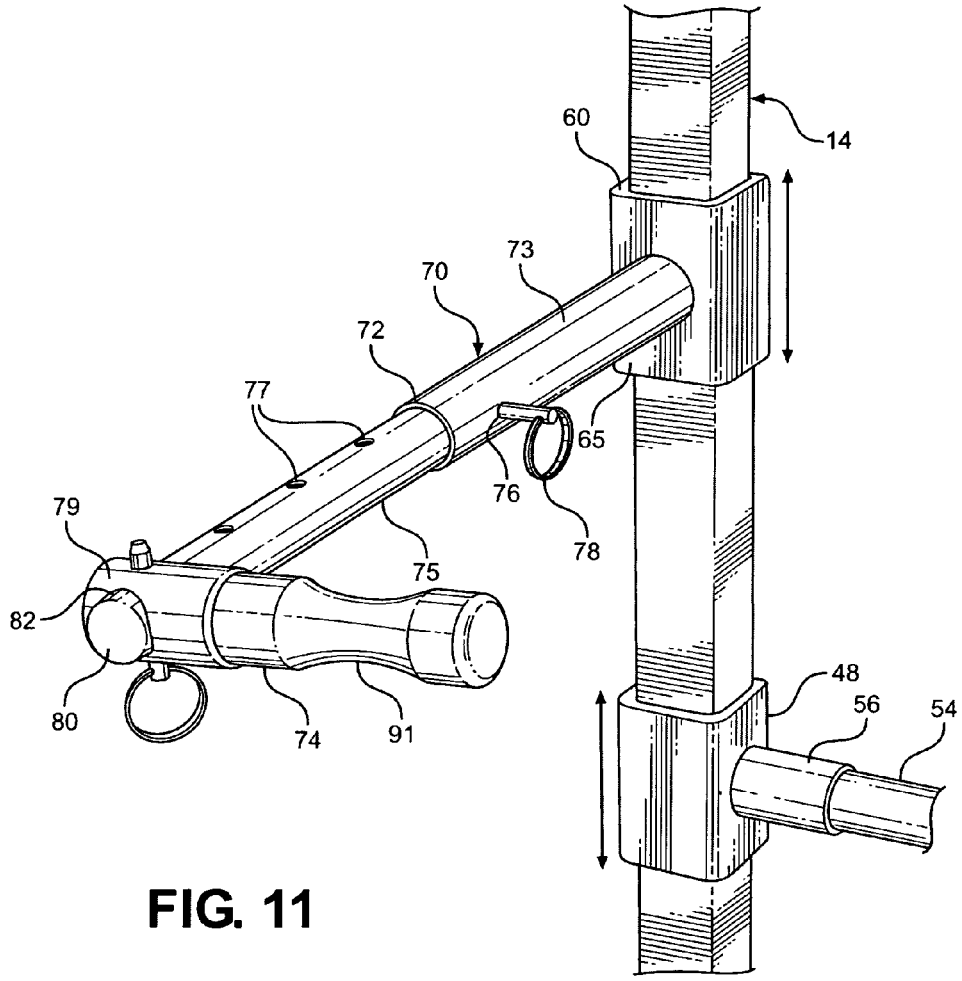
FIG. 11 is a detail view showing one of the leg support members.

A plurality of apertures 77 is formed in the sliding part 75. A secured end 79 of the portion 74 is provided with an opening 82 sized and shaped to allow a free end 80 of the sliding part 75 to pass therethrough , as can be seen FIG. 11. The shorter portion 74 of the L-shaped leg support 70 slides over the free end 80 of the part 75. The portion 74 can be moved closer to the upright member 14 by sliding the free end 79 over the part 75. A locking pin 84, which extends through the free end 79 and the free end 80, fits into one of the openings 77, locking the portion 74 in a desired position in relation to the portion 72. The portion 74 of the leg support member 70 is non-rotatably engaged with the portion 72.

The rotation of the part 75 in relation to the part 73 is prevented by the lock pin 78, while adjustment in the distance between the upright member 14 and the portion 74 of the leg support 70 is achieved using the locking pin 84. Depending on the size of the user's legs, the portion 74 can be moved closer to or farther from, the upright support 14. A non-engaged end 81 of the portion 74 extends toward the center of the frame.

The second leg support member 90 is a mirror image of the leg support 70; it has an L-shaped configuration and has a portion 92 secured to the support sleeve 62, while the shorter portion 94 faces toward the center of the frame and toward the shorter portion 74 of the first leg support member 70.

Each of the heel support portions 74 and 94 of the leg support members 70 and 90 has a reduced diameter double-tapered part 91 (shown in detail in FIG. 11), which supports the user's Achilles tendon during the exercises. The portions 74, 94 are non-rotatably engaged with the portions 72, 92, respectively thus providing a secure support for the user's legs.

Figure 2:
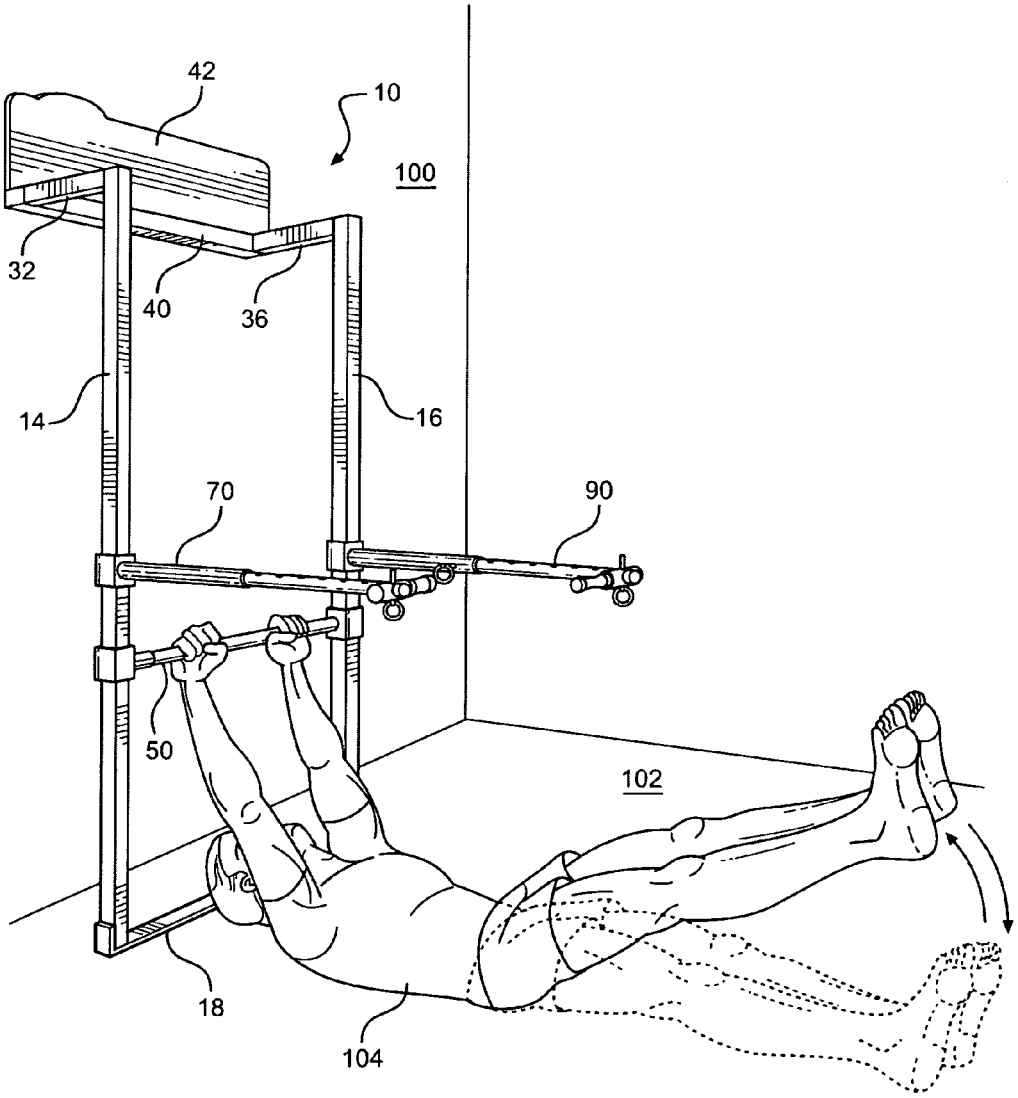
FIG. 2 illustrates the apparatus of the present invention and a user in a lying down position and performing a leg lifting exercise.
Figure 3:
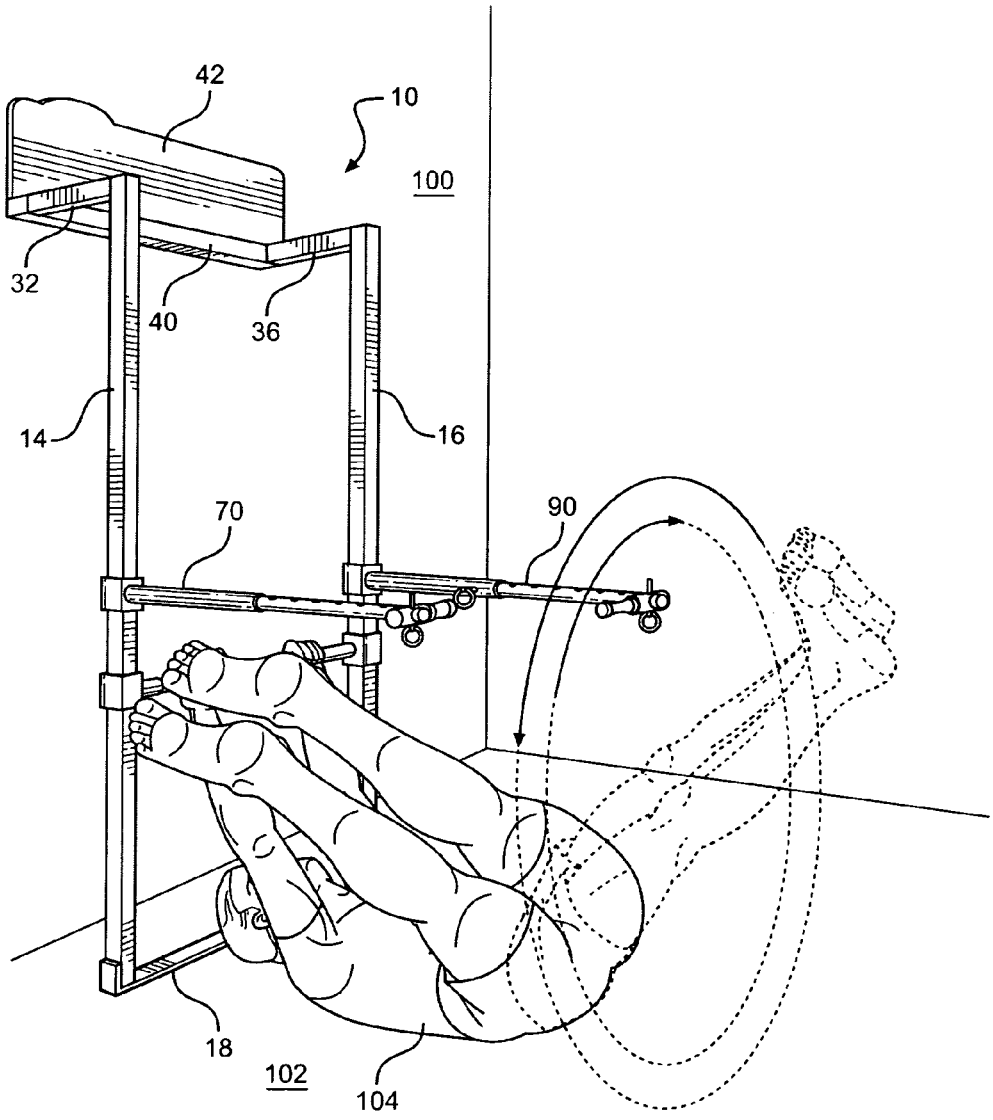
FIG. 3 illustrates the apparatus of the present invention and a user in a lying down position and performing a leg rotation exercise.

Turning now to FIGS. 1-7, the method of using the exercise apparatus of the present invention will be discussed in more detail. The exercise apparatus 10 is positioned near a wall 100 and the plate 42 is secured thereto. The base member 18 rests on the floor 102. The user 104 is positioned with his back on the floor 102 forwardly from the base member 18. While lying on the back the user grips the grip bar 50 above the user's head, as illustrated in FIG. 1. The user 104 then begins exercises lifting and lowering the legs as illustrated in FIG. 2 performing vertical leg crunch. Hips may be raised for a more challenging muscle strengthening.

Figure 4:
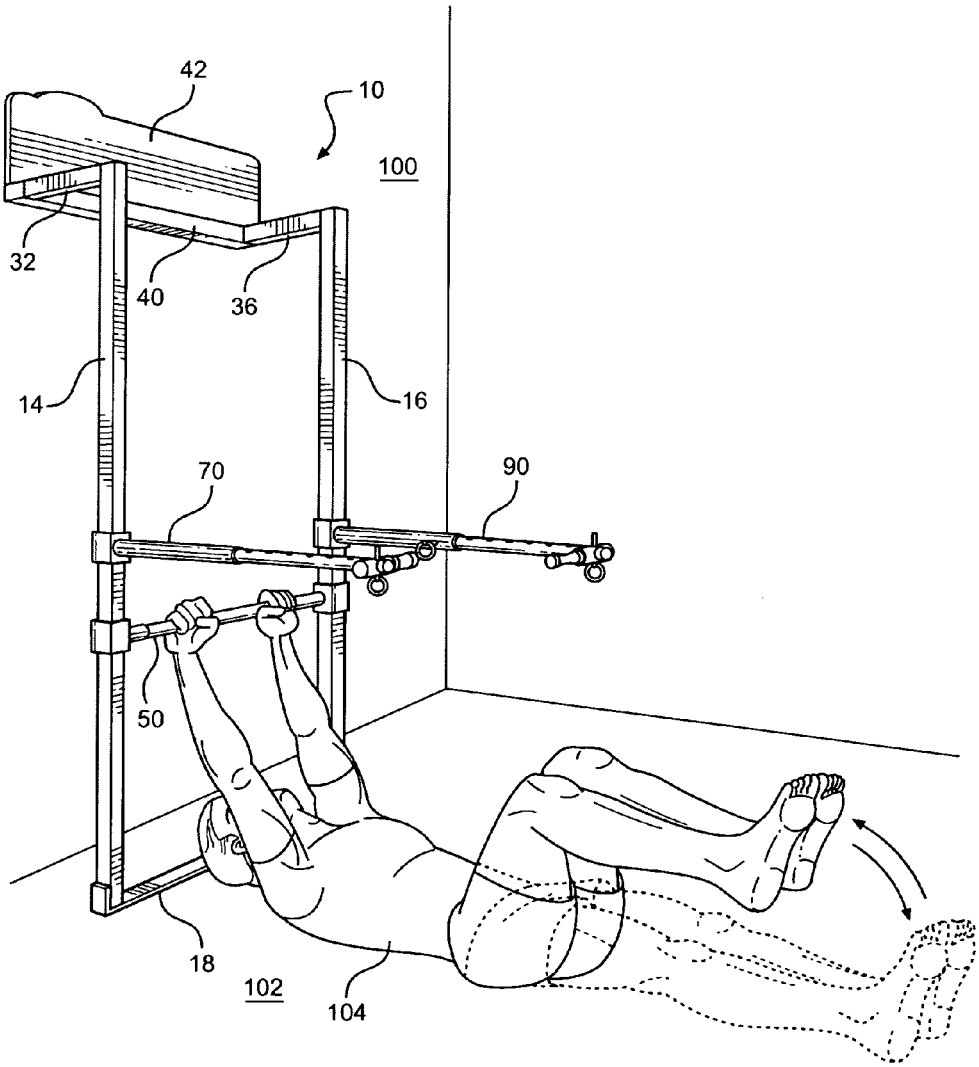
FIG. 4 illustrates the apparatus of the present invention and a user in a lying down position and performing knee bending exercise.

The user 104 can also perform lying twist exercises while gripping the grip bar 50. The user lifts his legs and slowly rotates his hips and legs to the left and to the right in an arcuate motion designated by phantom lines in FIG. 3. These exercises are particularly beneficial for the oblique muscles. FIG. 4 illustrates a variation of a lying leg raise, where the user 104, while lying on the back and holding on to the gripping bar 50 gradually bends the legs at the knees at lifts the legs off the floor in back and forth motion. This type of exercise is particularly target the lower rectus abdominis.

Figure 5:
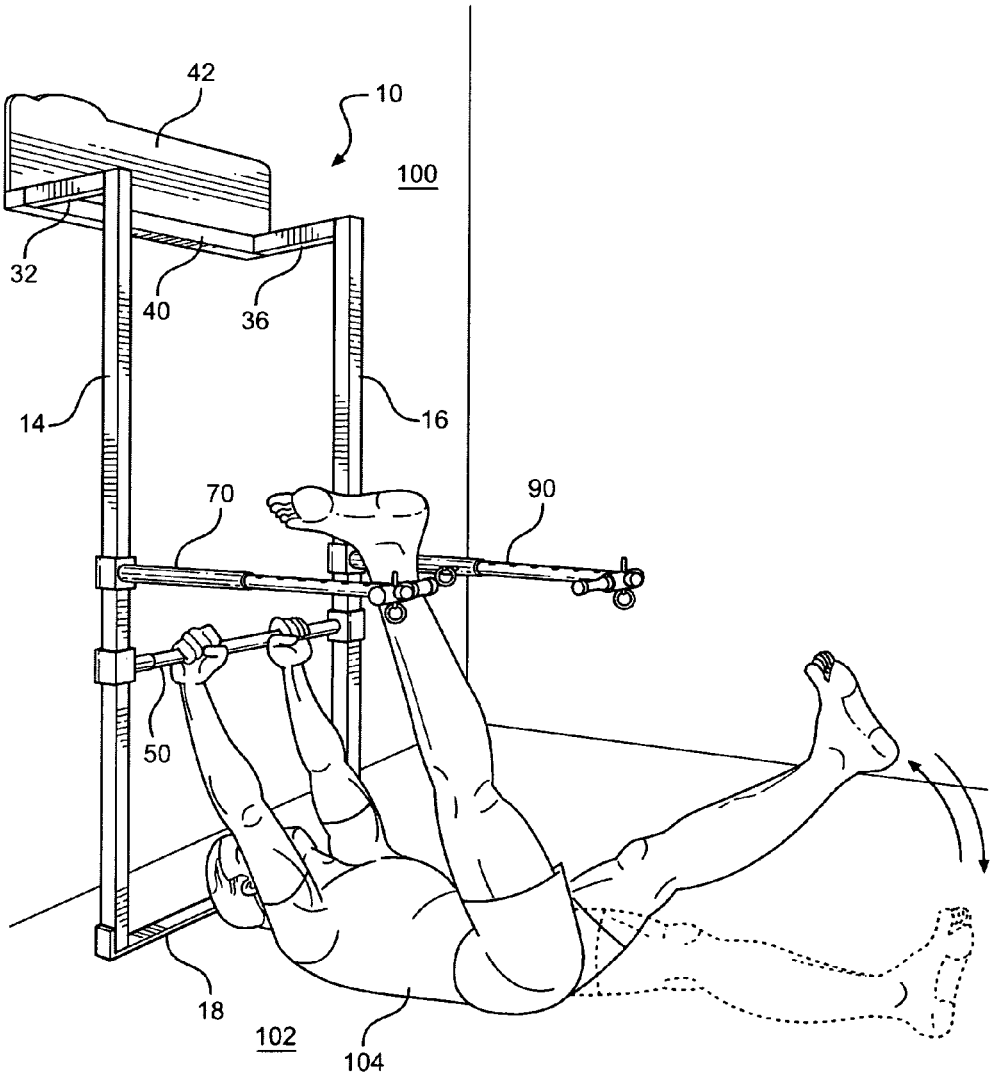
FIG. 5 illustrates the apparatus of the present invention and a user in a lying down position and performing an alternate leg lifting exercise.
Figure 6:
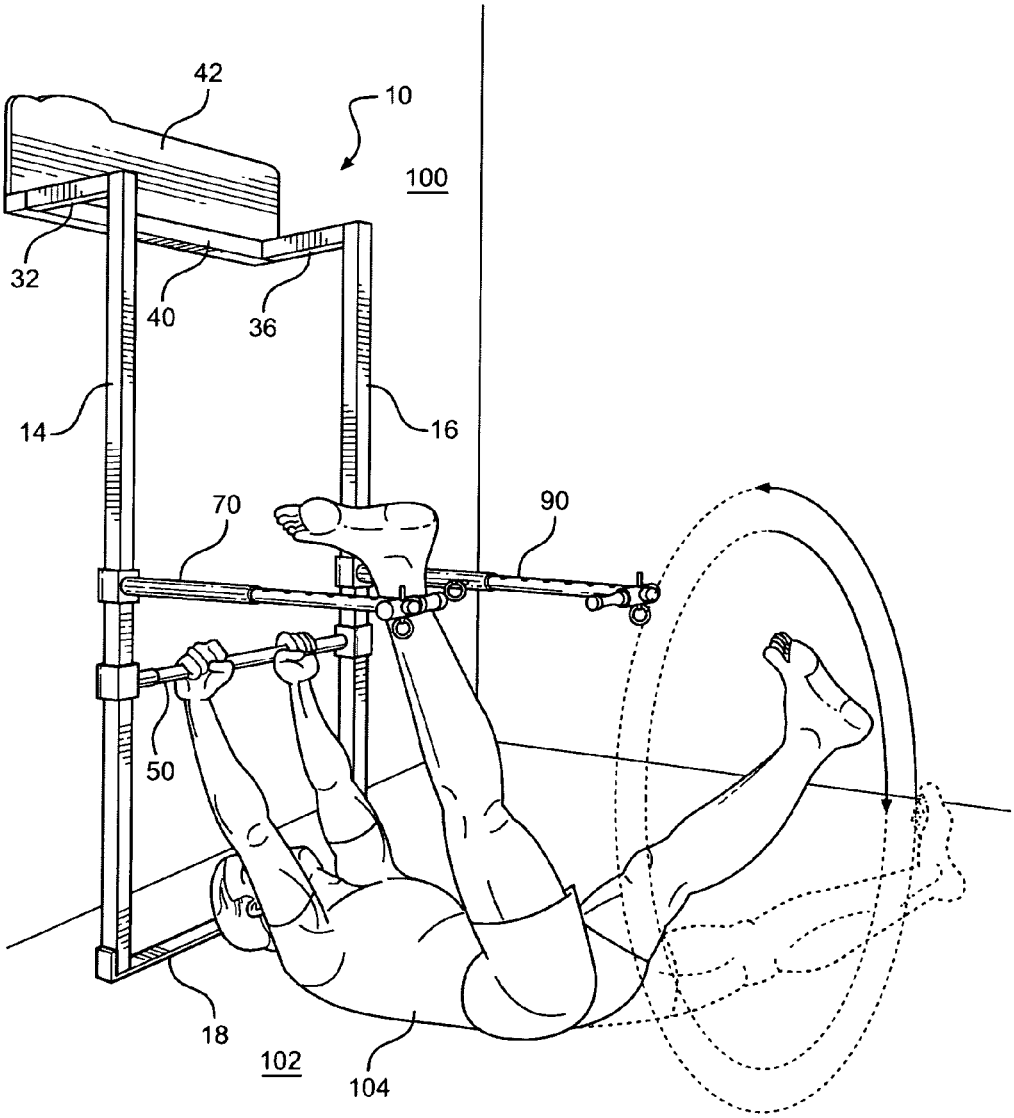
FIG. 6 illustrates the apparatus of the present invention and a user in a lying down position and performing an alternate leg rotation exercise.
Figure 7:
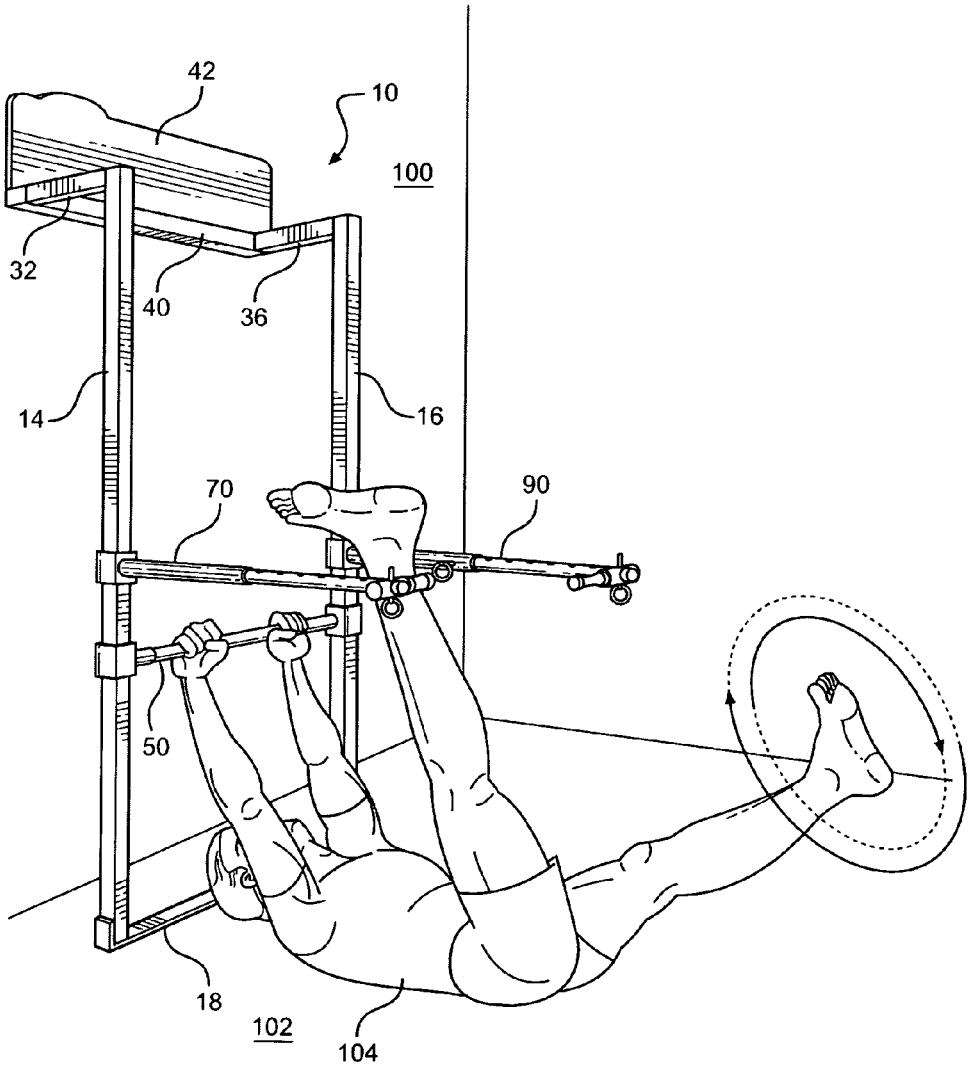
FIG. 7 illustrates the apparatus of the present invention and a user in a lying down position and performing an alternate leg rotation exercise using small radius of rotation.
Figure 8:
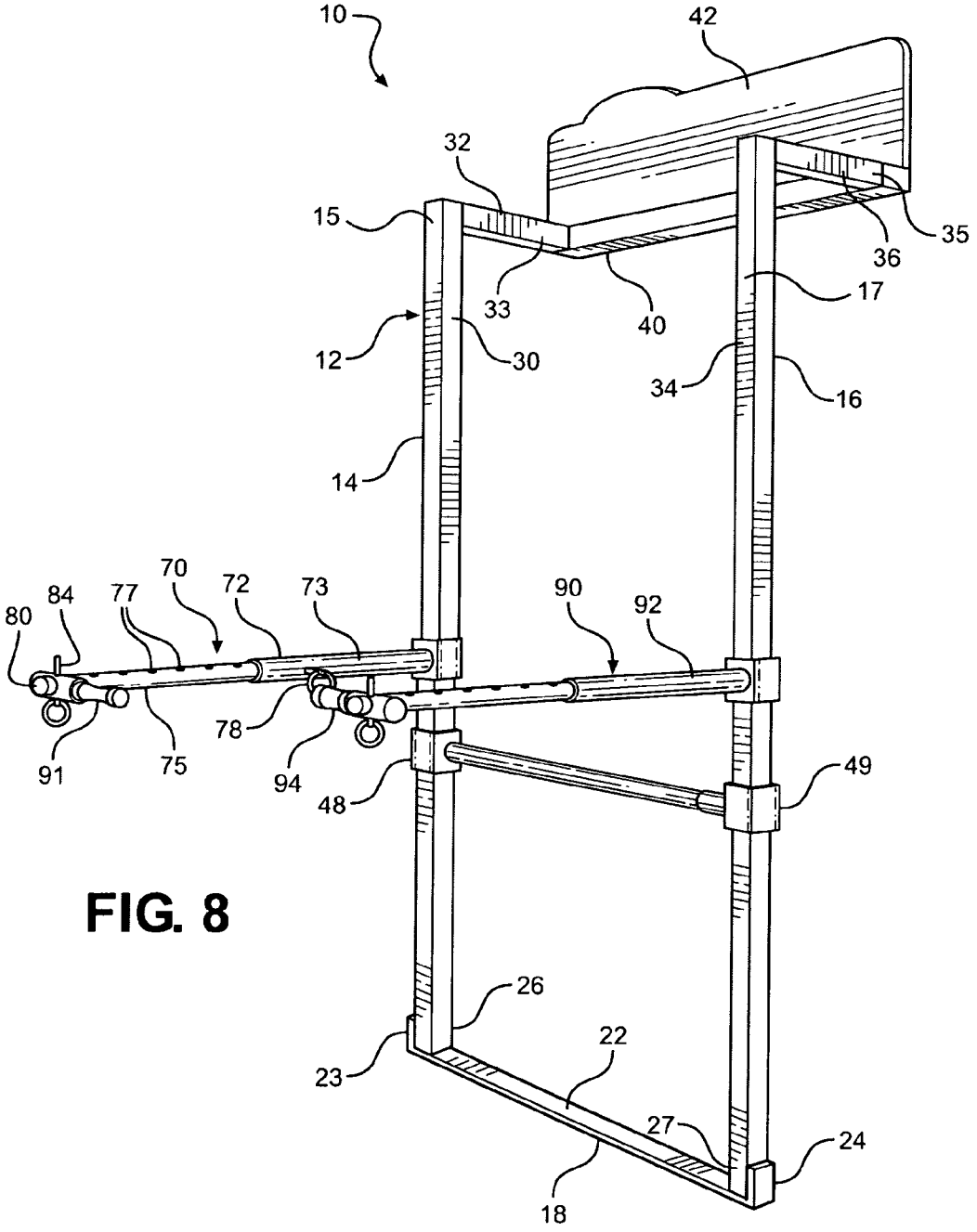
FIG. 8 is a perspective view of the apparatus of the present invention.
Figure 10:
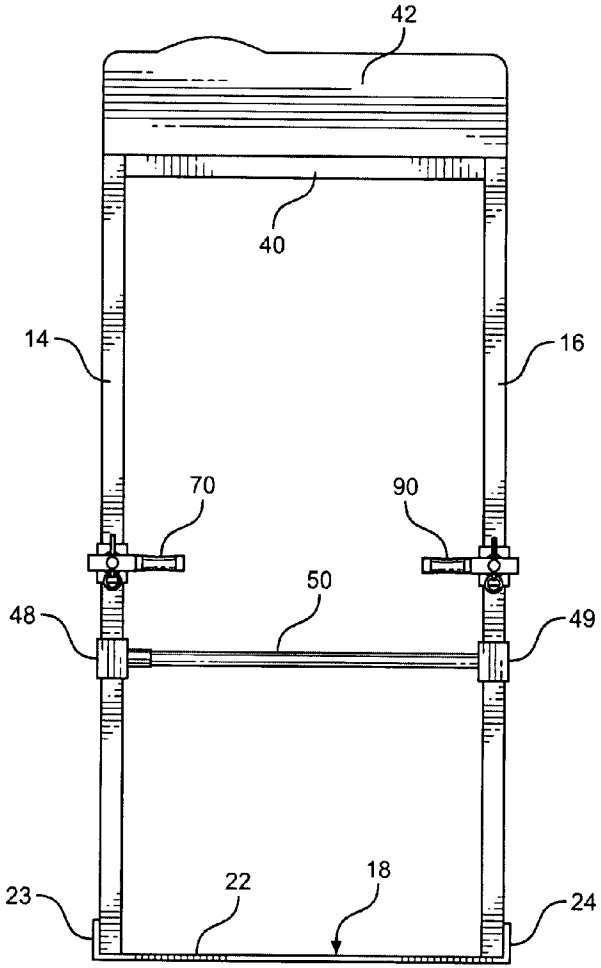
FIG. 10 is a front view of the exercise apparatus of the present invention.

FIG. 5 illustrates a variation of a lying leg crunch where the right leg of the user 104 is lifted and placed in contact with the double-taper part 91 of the leg support member 70. In this position, the Achilles tendon of the user bears against the double-taper part 91. The user 104 then lifts and lowers his left leg, while gripping the grip bar 50. While in the same position, the user can rotate the left leg, as shown in FIG. 6 using wide arcuate motions or small radius rotations as shown in FIG. 7. The user can then change the position, resting the left leg on the double taper part 91 of the leg support member 90. Other core muscle exercises can be performed as well using the exercise apparatus of this invention.

Depending on the arm extension of the user, the grip bar member 50 can be moved up or down along the upright members 14 and 16 to a user-predetermined position. The leg support members 70 and 90 can be vertically-adjusted to a user-predetermined position along the vertical extension of the upright members 14 and 16. The transverse heel support portions 74 and 94 can be moved closer and farther from the upright members 14 and 16 to accommodate the height and leg length of the user.

The apparatus of the present invention allows the user to exercise abdominal muscles without placing unnecessary strain on the back. The user does not flex the back, has no need to perform crunches and sit-ups. At the same time the exercise apparatus allows to stiffen the torso using the core muscles rather than the hips.

Many changes and modifications can be made in the design of the present invention without departing from the spirit thereof. I, therefore, pray that my rights to the present invention be limited only by the scope of the appended claims.

I claim:

1. A method of performing physical exercise comprising the steps of:

providing an exercise apparatus including:

a frame having a pair of parallel upright members connected by a base member at the bottom ends thereof;

a vertically-adjustable grip bar member positioned above the base member and detachably transversely secured to the upright members; and a pair of L-shaped leg-support members each having a first elongated portion non-rotatably secured to a respective upright member and a second portion extending at a right angle to the first portion, the second portion extending inwardly toward a center of the frame, the leg support members being adjustably positionable above the grip bar member and extending forwardly of the upright members;

positioning the user's torso forwardly of the base member, gripping the grip bar member with the user's hands while in a lying position;

moving the user's legs in a user-defined pattern without flexing user's torso;

resting the back of the heel of one leg on one leg-support member; and altering the movement pattern of the user's second leg.

2. The method of claim 1, further including the steps of:

removing the heel of the supported leg from the leg-support member resting the back of the heel of the user's other leg on the other leg-support member;

moving the non-supported leg in a user-defined pattern; and repeating the previous three steps.

* * * * *